US011085725B2

(12) United States Patent
Moore et al.

(10) Patent No.: US 11,085,725 B2
(45) Date of Patent: Aug. 10, 2021

(54) FIREARM SUPPRESSOR

(71) Applicants: Joshua Peter Moore, Fort Stockton, TX (US); Robert Oliver Wilson, III, Flower Mound, TX (US); Justin Colt Jackson, Dublin, TX (US)

(72) Inventors: Joshua Peter Moore, Fort Stockton, TX (US); Robert Oliver Wilson, III, Flower Mound, TX (US); Justin Colt Jackson, Dublin, TX (US)

( * ) Notice: Subject to any disclaimer, the term of this patent is extended or adjusted under 35 U.S.C. 154(b) by 0 days.

(21) Appl. No.: 16/750,834

(22) Filed: Jan. 23, 2020

(65) Prior Publication Data

US 2020/0240736 A1 Jul. 30, 2020

Related U.S. Application Data

(60) Provisional application No. 62/798,020, filed on Jan. 29, 2019.

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 181/223; 89/14.4
See application file for complete search history.

(56) References Cited

U.S. PATENT DOCUMENTS 785,974 A * 3/1905 McClean ..... F41A 5/26 89/193
1,901,138 A * 3/1933 Barnes ..... F41A 21/30 89/14.3
3,667,570 A * 6/1972 WerBell, III ..... F41A 21/30 181/223
8,844,422 B1 * 9/2014 Klett ..... F41A 21/30 89/14.2
8,978,818 B2 3/2015 Proske
9,086,248 B2 7/2015 Young
9,188,403 B1 * 11/2015 White ..... F41A 21/34
9,739,559 B2 8/2017 Bush
10,060,695 B2 * 8/2018 Slack ..... F41A 21/30
10,113,826 B2 10/2018 Bary
10,180,299 B2 * 1/2019 Morreau ..... F41A 21/30
(Continued)

OTHER PUBLICATIONS

"Making a Home-Made Silencer Part 6: Shooting it!" YouTube.com, Feb. 24, 2013, https://www.youtube.com/watch?v=P4TNpk6yYcQ.

*Primary Examiner* — Samir Abdosh
(74) *Attorney, Agent, or Firm* — Workman Nydegger

(57) ABSTRACT

A firearm suppressor with a monolithic core includes an elongate main body, a projectile borehole extending an entire length of the elongate main body such that the elongate main body includes both an entrance opening for the projectile borehole and an exit opening for the projectile borehole, and multiple hollow chambers. The entrance opening is structured to attach to an end portion of a barrel of a firearm. The hollow chambers are disposed along the length of the elongate main body and connect the projectile borehole to an outer surface of the elongate main body. A first one of the hollow chambers is disposed in a direction perpendicular relative to the projectile borehole, and a second one of the hollow chambers is disposed in a non-perpendicular direction relative to the projectile borehole.

16 Claims, 16 Drawing Sheets

(56) References Cited

U.S. PATENT DOCUMENTS

| | | | | |
|---|---|---|---|---|
| 2011/0297477 | A1* | 12/2011 | Koumbis | F41A 21/30<br>181/223 |
| 2013/0227871 | A1* | 9/2013 | Stone | F41A 21/30<br>42/76.1 |
| 2014/0059913 | A1* | 3/2014 | Diamond | F41C 27/00<br>42/90 |
| 2017/0067711 | A1* | 3/2017 | Slack | F41A 21/30 |
| 2018/0164065 | A1 | 6/2018 | Mohler et al. | |
| 2018/0321008 | A1 | 11/2018 | Barney | |

* cited by examiner

FIREARM SUPPRESSOR

CROSS-REFERENCE TO RELATED APPLICATIONS

This application claims priority to U.S. Provisional Application Ser. No. 62/798,020, filed on Jan. 29, 2019 and entitled "FIREARM SUPPRESSOR," the entirety of which is incorporated herein by reference.

BACKGROUND

A firearm suppressor, which is a type of device that attaches to a barrel of a firearm, is designed to reduce the amount of noise that is generated when the firearm is fired. More specifically, the suppressor muffles the expanding gases that are created when a projectile is fired through the firearm. Those propellant gases create a significant amount of noise when they expand and travel outward at the end of the barrel. As such, a suppressor may be affixed to the end of a firearm barrel in order to provide additional expansion channels through which the propellant gases can travel. By providing this additional expansion volume, those gases can be dispersed more uniformly and to a greater degree, thereby leading to quieter firearm operation.

Today, there are many different types of suppressors. Each of these suppressors are designed to reduce the noise levels of the firearm. Although suppressors are widely available and widely used, the design of these suppressors can be improved.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

Embodiments disclosed herein relate to a specialized type of firearm suppressor that allows for the efficient and quick expansion of propellant gas created from firing a projectile in order to decrease the amount of noise created by the firearm's discharge.

In some embodiments, the firearm suppressor has a monolithic core comprising an elongate main body, a projectile borehole, and a plurality of hollow chambers. The projectile borehole (or central through hole) is disposed along an inner length of the elongate main body. A projectile from a firearm travels through the suppressor (and in particular through the borehole) before reaching its intended trajectory or destination. The plurality of hollow chambers (or gas exit chambers) are designed to have varying sizes and are further structured to connect the projectile borehole to the outer surface of the elongate main body. A first one of these hollow chambers is disposed in a direction perpendicular to the projectile borehole (e.g., in the lengthwise direction), and a second one of the hollow chambers is disposed in a direction non-perpendicular or oblique to the projectile borehole. In this manner, the propellant gas created from the firearm's discharge is directed at both a perpendicular and a non-perpendicular angle relative to the projectile borehole. Optionally, the first hollow chamber may interconnect with the second hollow chamber to create a pair of bi-directional (or multi-directional), interconnected hollow chambers. Optionally, the firearm suppressor may also include a detachable sleeve structured to cover the elongate main body, where the sleeve acts to disperse heat created from firing a projectile through the suppressor's main body.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings in which.

DETAILED DESCRIPTION

Figure 1:
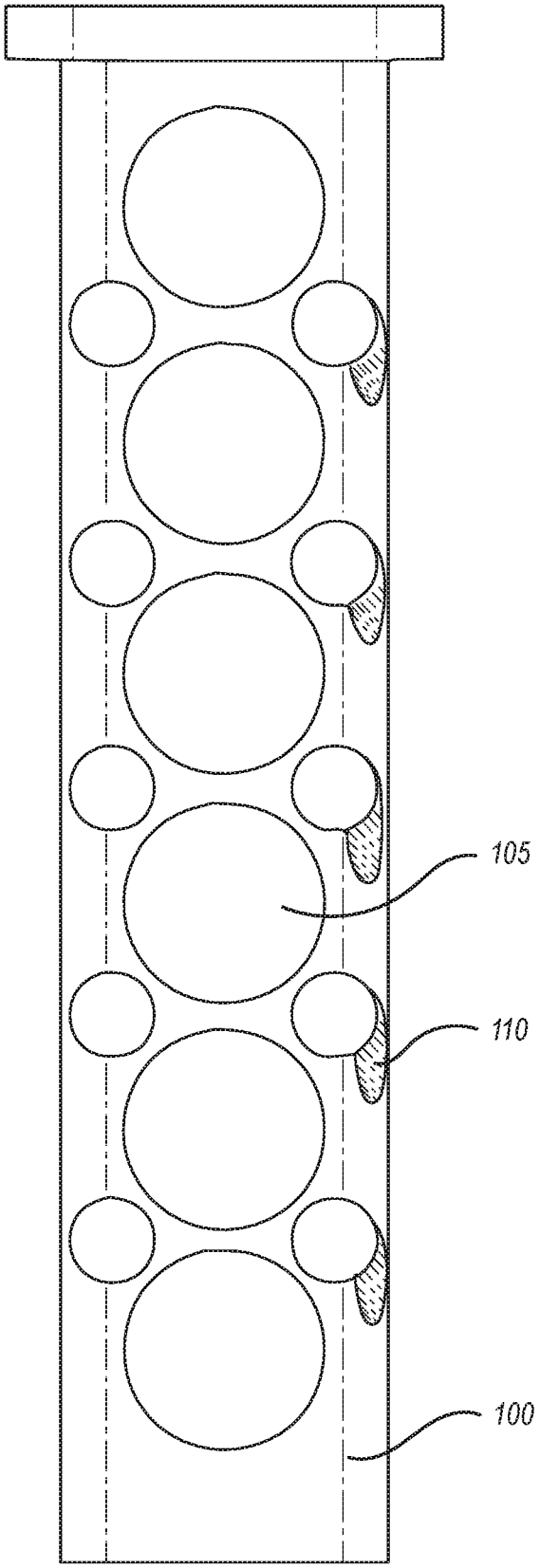
FIG. 1 illustrates an example suppressor with a number of different baffle chambers, or rather "hollow chambers," designed to help facilitate the suppressed expansion of propellant gas.

The disclosed embodiments relate to an improved firearm suppressor design including a monolithic core comprising an elongate main body, a projectile borehole, and multiple hollow (or baffle) chambers which may be interconnected or structured in various manners. At least one hollow chamber is disposed in a direction perpendicular to the projectile borehole (e.g., relative to the length of the borehole) while another hollow chamber is disposed in a direction non-perpendicular to the projectile borehole. In this manner, the propellant gas created from the firearm's discharge is directed in multiple directions through different channels or chambers. Optionally, two or more hollow chambers are interconnected to form a pair of multi-directional, interconnected hollow chambers, and a sleeve may be used to envelope the monolithic core.

By way of additional clarification, the suppressor is comprised of an elongate main body, in some cases an elongate cylindrical body, that includes a projectile borehole running the length of the body allowing for an entrance opening and an exit opening disposed on distal ends of the elongate main body. This borehole (or through hole) is provided for a firearm projectile to travel through after exiting the firearm's barrel. That is, the main body portion is attachable to an end portion of the firearm barrel and is structured to be able to receive a projectile after the projectile exits the barrel's end. The suppressor may be attached to the firearm's barrel in any number of ways, including quick detach (QD) attachment or even a screw on attachment.

In one example, the entrance opening is configured to be removably attached to an exit opening of the firearm's barrel. It should be appreciated that both the entrance opening and the exit opening can be structured to be able to receive or be removably attached to an end of the firearm's barrel. This allows the entrance and the exit openings to be utilized interchangeably in the connection of the firearm to the firearm suppressor, thereby allowing the firearm suppressor to function in a reversible manner. In some embodiments, the suppressor core may be integrally structured with the firearm.

The projectile borehole may be disposed along a central axis inside the elongate main body or along any inner length of the elongate body. For instance, in a case where the elongate main body is cylindrical in shape, the borehole may be disposed along the central length or axis of the cylinder. In a case where the elongate main body is not cylindrical in shape (e.g., any type of polygonal prism, where the polygonal prism may have rounded length-wise edges or more sharply defined length-wise edges), the borehole may be disposed along any length-wise position of the polygonal prism. In such cases, the borehole may be closer to one length-wise edge of the polygonal prism than another length-wise edge.

The elongate main body additionally includes a number of chambers, which are hollowed out portions of the elongate main body (or simply "main body"). These chambers are specially engineered to provide pathways through which propellant gas, which was generated as a result of the firearm being discharged, may travel. By configuring the chambers in the manners described herein, the propellant gas is able to expand in a manner so as to reduce the amount of noise created by the firearm's discharge. Additionally, the chambers of the body are specially designed to allow the gas to escape from both a perpendicular and a non-perpendicular direction relative to the projectile borehole of the body. That is, at least one (though potentially more than one, such as 2, 3, 4, 5, 6, 7, 8, 9, 10, or even more than 10) of the chambers exit outward from the body in a perpendicular angle relative to the projectile borehole, and at least one of the exit chambers direct the gas at an oblique, acute, obtuse, or non-perpendicular angle relative to the projectile borehole.

By way of example, the non-perpendicular chambers may be angled with respect to the central bore hole. This angle may be set to any angle between 1 degree and 89 degrees. Some common angles include, but are not limited to 20 degrees, 30 degrees, 45 degrees, 60 degrees, and even 80 degrees. As indicated above, however, the angle magnitude may be set to any value between 1 degree and 89 degrees, without limit.

Accordingly, the disclosed embodiments bring about significant advantages to the technical field of suppressor design. One such advantage includes the feature of providing a zero point impact shift, which will be described in more detail later. Another advantage of the disclosed embodiments is the feature of reducing, or even eliminating, heat distortion near the firearm's aiming sights (e.g., by placing chambers at positions away from a top area near the firearm sights). By reducing/eliminating heat distortion in-line with the sighting mechanisms, the embodiments assist the firearm operator in accurately aiming the firearm.

Another advantage of the disclosed embodiments is related to heat dispersion in that the suppressor, which includes a core main body and a sleeve, can be manipulated even after multiple rounds of ammunition have been fired through the suppressor. That is, because the suppressor is designed to release heat very quickly, the suppressor can be touched or otherwise manipulated very readily, even after multiple projectiles have been fired therethrough. Accordingly, the disclosed embodiments may be used to bring about many benefits and advantages.

Turning now to FIG. 1, there is shown a suppressor core 100, which is sometimes referred to herein as a monolithic core and which includes an elongate main body. This suppressor core 100 includes any number of large exit chambers (e.g., large exit chamber 105) and any number of smaller exit chambers (e.g., small exit chamber 110). In some embodiments, the size of large exit chamber 105 may be anywhere between two to four times the diameter of the size of small exit chamber 110. In some embodiments, the volume of the large exit chamber 105 may be anywhere between two to four times the volume of the small exit chamber 110.

In some embodiments, the size of the large exit chamber 105 is between about 0.75 inches and about 1.25 inches in diameter, or any value therebetween. Although FIG. 1 shows the large exit chamber 105 and the small exit chamber 110 as being circular in shape, the embodiments should not be limited only to circularly-shaped chambers. Indeed, the shapes of the chambers may be set to any shape without limit. Additionally, the volume of these chambers may be set to any engineered volume. In some cases, some of the chambers have relatively larger volumes as compared to other chambers, which have relatively smaller volumes. In some cases, some chambers have relatively larger diameters as compared to other chambers, which have relatively smaller diameters. Some chambers are shaped in a circular manner while other chambers are shaped as rounded polygons. A CNC machine or additive printing technique may be used to generate non-circular chambers.

The top portion of suppressor core 100 is shown as including a collar. When the suppressor core 100 is fitted with a sleeve (to be discussed in more detail later), the sleeve will be positioned so as to abut the collar, and the collar will help keep the sleeve in position. Embodiments disclosed herein may be configured so that the collar can be positioned on either end of the suppressor core 100 (e.g., the barrel-connecting end of the suppressor core 100 or, alternatively, the projectile exit end of the suppressor core 100).

Additionally, the length of the suppressor core 100 can be set to any size, with larger lengths for larger caliber firearms and smaller lengths for smaller caliber firearms. In some embodiments, the suppressor core 100 may be structured as an elongate cylindrical body. In some embodiments, the suppressor core may be structured as any elongated shape, including a rectangular, polygonal, or other shape allowing for the travel of a projectile through an inner length of the body of the suppressor.

Additionally, the diameter sizes of the large exit chamber 105 and the small exit chamber 110 may also be dependent on the caliber of the firearm. The sizes or shapes of the large exit chamber 105 and the small exit chamber 110 may be equal sizes and may have similar structure of shapes or may comprise varying sizes and shapes. In some embodiments, the total volume hollowed or removed from the elongate main body to form the exit chambers may be tuned to be proportional to or greater than the volume of propellant gas formed from firing a certain type or caliber of projectile.

The firearm suppressor may be structured to accommodate or may be configured to be removably attached to various types or calibers of firearms and their associated projectiles, including rimfire firearms, centerfire firearms, pistol caliber firearms, rifle caliber firearms, or even potentially large bore firearms. The projectile borehole and plurality of hollow chambers disposed along the elongate main body may be configured to accommodate any caliber ammunition including 9 mm, .223, .380, and .550. The caliber of firearm may range from .17 to .50 caliber or from 5.56 mm to 9 mm. Ultimately, the firearm suppressor may be structured or dependent on the bore size of a firearm, the pressure of the projectile, and the size and weight of the firearm. In some cases, it is beneficial to consider the ratio of the size and weight of the firearm to the firearm suppressor for optimal use of the firearm in terms of accuracy and comfort.

In some embodiments, suppressor core 100 may include any number of equally sized exit chambers (hollow chambers, such as the large and small exit chambers 105 and 110, respectively) or alternatively may comprise a plurality of exit chambers structured in any number of sizes. These chambers may also be described as hollow chambers, as they can be structured as cavities disposed throughout the suppressor core 100. Some implementations of the chambers are designed as a plurality of baffle chambers structured to be integral with each other. In this case, the baffle chambers are disposed within or on an elongate main body and are interconnected to form a monolithic core for the suppressor.

As shown in FIG. 1, the large exit chamber 105 (or large hollow chamber) is perpendicular relative to a central through hole or projectile borehole (not shown in FIG. 1) that passes through the central region/axis of the suppressor core 100. That is, the projectile borehole extends throughout the entire length (e.g., from top to bottom, or vice versa, in FIG. 1) of the suppressor core 100, and the large exit chamber 105 is shown as extending perpendicularly relative to the length of the borehole.

The projectile borehole may also be described as an elongate hollow chamber having openings at opposing ends of the elongate body of the suppressor core 100. When a projectile is fired through a firearm, the projectile initially travels the length of the firearm's barrel and then enters one end (e.g., either the top end or the bottom end of the suppressor core 100 shown in FIG. 1). The projectile then travels the length of this suppressor core 100, until it escapes the projectile borehole through the other end or exit opening of the suppressor core 100.

With the travel of the projectile, propellant gases also travel the length of the firearm's barrel and the suppressor. These propellant gases are used to propel the projectile through the firearm. As described earlier, however, the expansion of these propellant gases is quite loud and causes a significant amount of noise. In some situations, it is desirable to muffle this noise. Consequently, the designed suppressor is able to muffle this noise by providing additional expansion chambers (e.g., the large exit chamber 105 and the small exit chamber 110) through which the propellant gases may travel/expand. By providing this additional expansion volume, the disclosed embodiments are able to substantially muffle the noise generated by the firearm.

In some embodiments, the suppressor core 100 is designed to have different types of small exit chambers. For instance, on the left-hand side of suppressor core 100, there is provided a number of single small exit chambers. In contrast, on the right-hand side of suppressor core 100, there is provided a number of interconnected and proximate/overlapping small exit chambers. These interconnected small exit chambers are designed to cause the propellant gases passing therethrough to pass in a non-perpendicular angle relative to the projectile borehole. Whereas traditional suppressors are designed with exit chambers that are perpendicular relative to the projectile borehole, it will be appreciated that the disclosed embodiments include small exit chambers whose directions are non-perpendicular, or rather oblique, relative to the projectile borehole or central through-hole.

It will also be appreciated that each of the small exit chambers (e.g., small exit chamber 110) and each of the large exit chambers (e.g., large exit chamber 105) are connected to the projectile borehole traveling the length of the suppressor core 100, thereby connecting the central through hole or projectile borehole to an outer surface of the suppressor core and its elongate main body. In this manner, as the projectile and propellant gases traverse the length of the suppressor core 100, some of the propellant gases will be dispersed through the connected channels and chambers, thereby suppressing the total amount of noise that is generated.

In some cases, the sizes of the large exit chambers (e.g., large exit chamber 105) may vary in size relative to one another. For instance, large exit chambers that are positioned proximately to the barrel-connecting end of the suppressor may be larger in size than large exit chambers that are positioned proximately to the projectile exit end of the suppressor. By positioning larger exit chambers closer to the barrel, relatively more gas can be expanded earlier along the projectile's trajectory, thereby producing a greater muffling effect. Similar sizing configurations may be used for the small exit chambers (e.g., the small exit chambers are relatively larger in size near the barrel-connecting end of the suppressor as compared to those chambers positioned proximately to the projectile exit end of the suppressor).

By way of a specific example and with reference to FIG. 1, suppose the top portion of the suppressor core 100 is the barrel-connecting end (i.e. the end that connects to the firearm's barrel) and the bottom portion of the suppressor core 100 is the projectile exit end of the suppressor. In this scenario, the top-most large exit chamber may be structured to have the largest diameter (as compared to the other large exit chambers). The second top-most large exit chamber may be smaller in diameter than the top-most large exit chamber but may still be larger than the remaining large exit chambers. In this regard, the diameters of the large exit chambers may progressively reduce in size from the barrel-connecting end to the projectile exit end. This reduction in size may be based on a proportional value (e.g., 1%, 2, 3, 4, 5, 6, 7, 8, 9, or perhaps even 10% reduction for each successive large exit chamber) or, alternatively, may be a fixed sized reduction (e.g., a specific value in inches or millimeters).

Returning to FIG. 1, at least two small exit chambers are connected to one another (i.e. overlap), as shown on the right-hand side of the suppressor core 100. By interconnecting multiple chambers together, the disclosed embodiments are able to redirect the propellant gases in a non-perpendicular manner. Such re-direction, bi-directional, or even multi-directional channeling has proven to help with the gas dispersal process. It is anticipated that the proximate, interconnected or intersecting hollow chambers (e.g., the small exit chambers) may be structured as any number of equal sizes or may be structured in any number of variant sizes.

As illustrated in FIG. 1, in one embodiment, the firearm suppressor comprises a plurality of large hollow chambers (e.g., one of which is the large exit chamber 105) aligned in series with a plurality or series of small hollow chambers (one of which is small exit chamber 110) aligned in an adjacent or proximate configuration to the large hollow chambers, in which the large and small hollow chambers are interconnected with the projectile borehole (not pictured in FIG. 1). In some embodiments, the series of large hollow chambers may be further connected to each other via an elongated hollow channel spanning a radial width of the suppressor core from the outer circumference of the projectile borehole reaching the outer surface of the elongate main body, where the elongated hollow channel is disposed along the entire length of the elongate main body of the suppressor core 100.

In some cases, the series of hollow chambers may be structured as a large hollow chamber followed by a small hollow chamber, followed by another large hollow chamber, and so on throughout the length of the main body. In some cases, as shown in FIG. 1, the series of differently sized hollow chambers are not necessarily aligned along the same directional axis, but rather either the small or the large hollow chambers may have a positional offset relative to the directional axis to form something akin to a staggered, zig-zag, or cross-stitch pattern. In some embodiments, the large and small hollow chambers are aligned along the same directional axis, however.

In some cases, as shown in FIG. 1, a large exit chamber is positioned closest to the barrel-connecting end of the suppressor while in other cases, one or more small exit chambers are positioned closest to the barrel-connecting end. Similarly, in some cases, a large exit chamber is positioned closest to the projectile exit end of the suppressor core 100 while in other cases, one or more small exit chambers are positioned closest to the projectile exit end.

Figure 2:
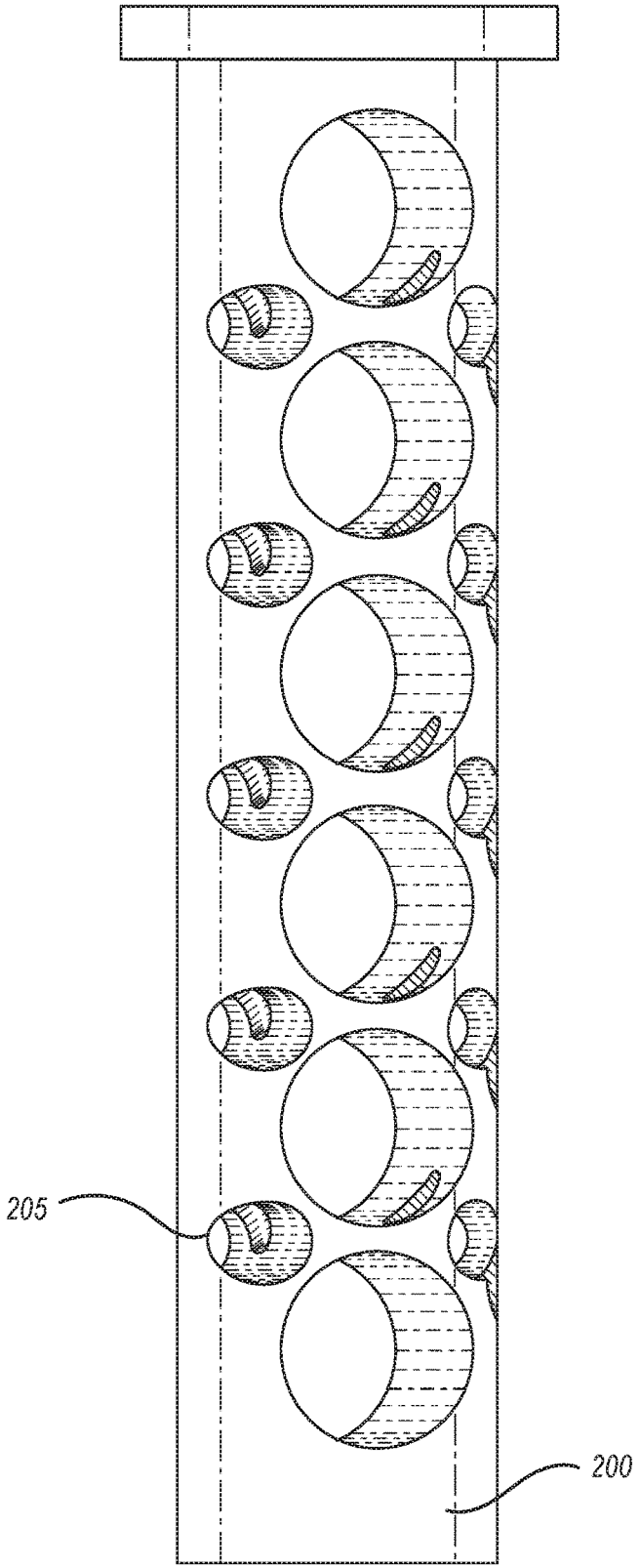
FIG. 2 illustrates a slightly rotated view of the suppressor with the hollow chambers.

FIG. 2 more fully illustrates the left-hand small exit chambers. Specifically, FIG. 2 shows a suppressor core 200, which is representative of the suppressor core 100 of FIG. 1 but which has been rotated slightly. Here, the small exit chambers (e.g., small exit chamber 205), or rather small hollow chambers, are representative of the left-hand small exit chambers discussed in connection with FIG. 1.

As shown, small exit chamber 205 includes only a single hollow chamber, as opposed to the right-hand small exit chambers of FIG. 1 in which multiple chambers were positioned proximate/overlapping to one another and which were used to redirect the propellant gas in a non-perpendicular manner. In contrast to those small exit chambers, the left-hand small exit chambers, which include small exit chamber 205, are structured to disperse gas in a perpendicular manner to the projectile borehole.

Figure 3:
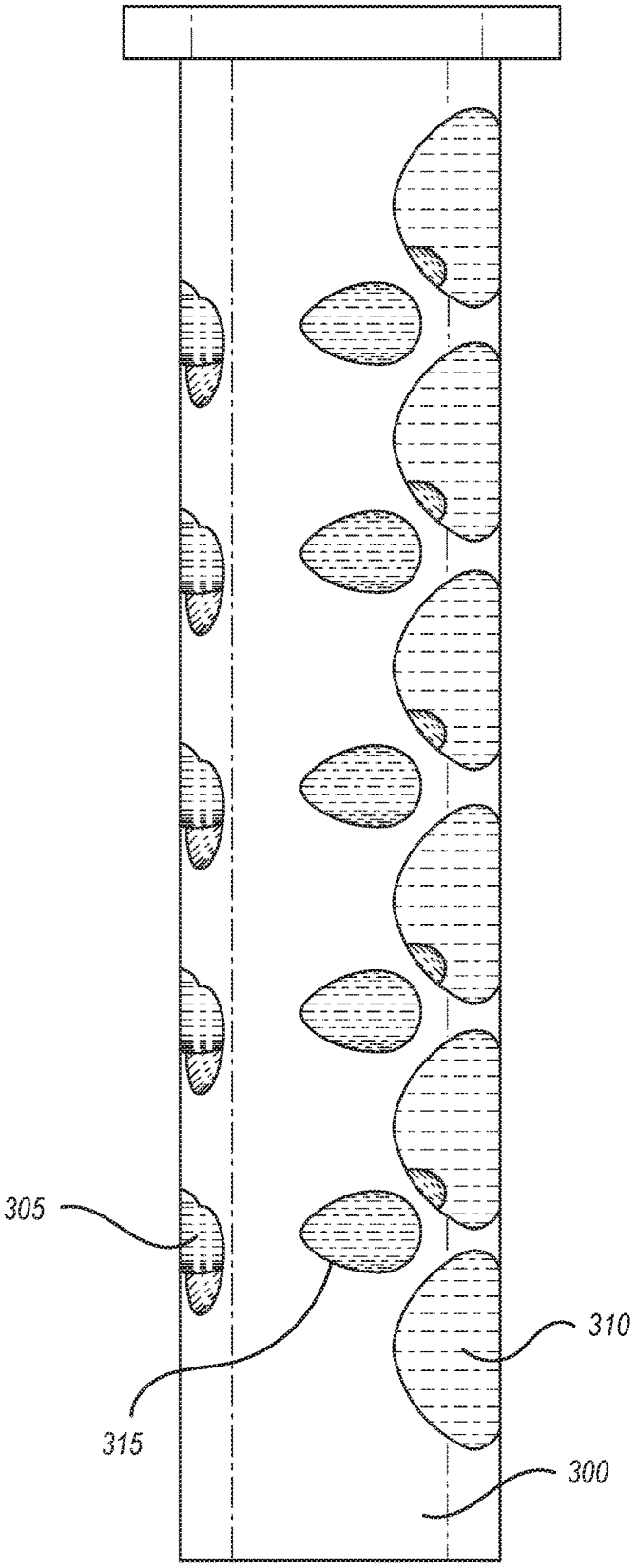
FIG. 3 illustrates a further rotated view of the suppressor.

FIG. 3 shows a suppressor core 300, which is representative of the suppressor core 200 of FIG. 2 but which is rotated even further. Here, some additional small exit chambers (e.g., small exit chamber 305) are shown. The large exit chambers (e.g., large exit chamber 310) and the small exit chambers (e.g., small exit chamber 315) are also shown. It will be appreciated that the small exit chamber 305 and 315 are actually the same chamber in that a single bore hole runs through the width of the suppressor core 300, thereby connecting the exit areas represented by small exit chambers 305 and 315.

The opening of the small exit chamber 315 is structured to allow for the expansion or release of propellant gas in a direction perpendicular to the central axis of the projectile borehole and the opening of the small exit chamber 305 is structured to allow for the travel of propellant gas in a direction non-perpendicular to the central axis of the projectile borehole. In some embodiments, the small exit chambers 305 and 315 constitute a single bore hole while in other embodiments, the small exit chambers 305 and 315 may be structured or manufactured as separately hollowed out portions of the suppressor core's main body. In either case, the small exit chambers beneficially connect a portion the projectile borehole to an outer surface of the elongate main body of the suppressor core, or connect a portion of the large exit chamber 310 to the outer surface of the projectile borehole. The large exit chamber may be interconnected with a portion of the projectile borehole.

In FIG. 3, a plurality of large exit chambers or large hollow chambers (e.g., one of which is large exit chamber 310) are shown disposed along the entire length of the suppressor core at uniformly spaced intervals and are aligned along a single axis. Here, chambers having larger volumes are located at uniform distances or uniform lengths along the length of the elongate main body. Similarly, chambers have smaller volumes are located at uniform distances or uniform lengths along the length of the elongate main body.

In some embodiments, the suppressor core 300 may comprise any number of large exit chambers (e.g., one of which is large exit chamber 310), disposed in any number of orientations with respect to each other as disposed on the suppressor core 300. In one example, the plurality of large exit chambers may be disposed in a diagonal line or spiral configuration across the suppressor core 300 or the plurality of large exit chambers may be spaced in non-uniform intervals.

Figure 4:
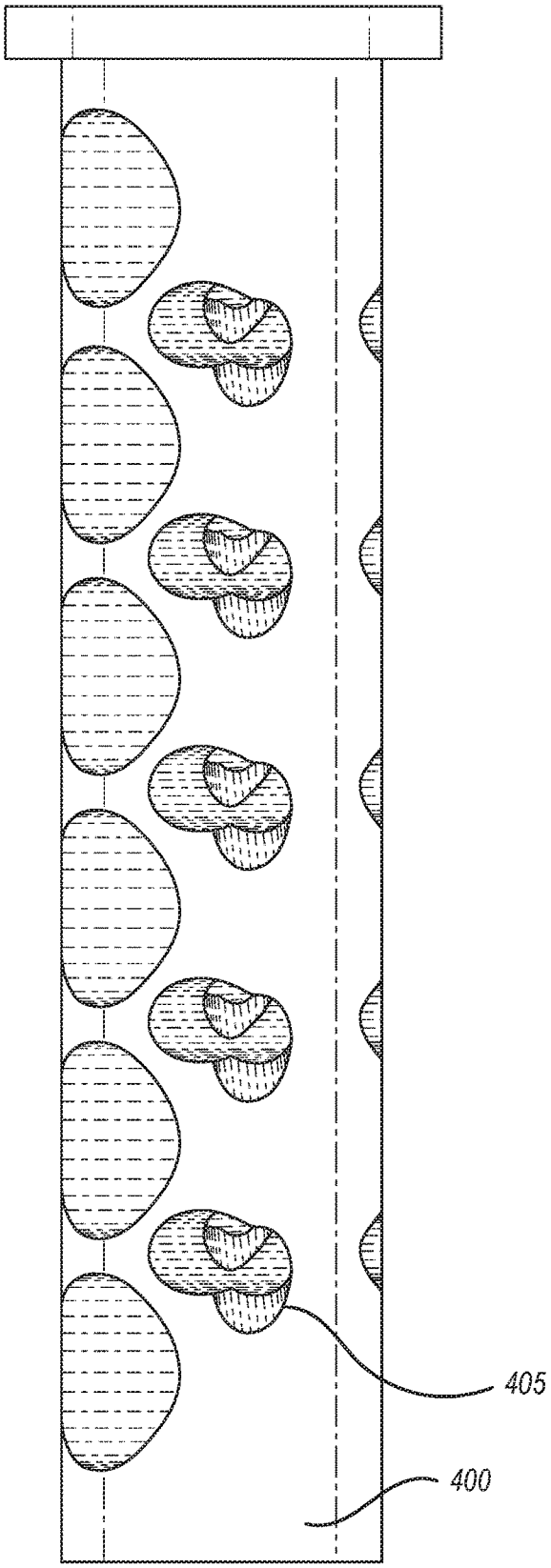
FIG. 4 illustrates another view of the suppressor, including a number of proximate, interconnected hollow chambers.

FIG. 4 shows suppressor core 400, which is representative of suppressor core 300 of FIG. 3 but which is rotated even further. Notice, the suppressor core 400 additionally includes a set of proximately positioned small exit chambers (e.g., small exit chamber 405) in which at least two chambers are positioned as at least partially overlapping one another. At least one of the chambers is drilled, or rather manufactured (e.g., in the case of additive 3D printing), so as to redirect propellant gases in a non-perpendicular manner relative to the central through hole.

In some embodiments, the set of small exit chambers may be structured as proximate, but not overlapping on the outer surface of the suppressor core 400, and the set of proximate, small hollow chambers have the appearance as being integrally separate on the outer surface of the suppressor core but are structured so as to interconnect with each other at an inner portion of the suppressor core. One or both of the individual exit chambers may include the set of proximate, interconnected chambers and may be interconnected with the projectile borehole. In some cases, the small exit chambers may be interconnected with the large exit chamber or both the borehole and the large exit chamber allowing the propellant gas to expand from the projectile borehole to the outer surface of the suppressor core. In some cases, the small exit chamber is connected directly to the large hollow chamber while being only indirectly connected to the central borehole via the large hollow chamber (i.e. the small exit chamber is not directly drilled or connected to the central borehole).

Worthwhile to note, the suppressor core 400 includes two different sets of proximately positioned small exit chambers. For instance, if the suppressor core 400 were to be laid flat along its length side, a side corresponding to its "top" side may include one set of overlapping chambers and a side corresponding to its "bottom" side may include another set of overlapping chambers, where the bottom side is at a position on the suppressor opposite to that of the top side. Notably, the top side may direct propellant gas outwards towards one end (e.g., perhaps towards the right) while the bottom side may direct propellant gas outwards towards the other end (e.g., perhaps towards the left). In this manner, propellant gas can be simultaneously directed outward in opposing directions through a top set of proximate and interconnected small exit chambers and a bottom set of proximate and interconnected small exit chambers. Beneficially, the suppressor can be positioned on the firearm's barrel in numerous different ways, some of which allow the hollow chambers to be directed horizontally relative to the barrel so as to reduce the amount of heat emitted upwardly off of the suppressor in order to reduce impairments while sighting down the length of the barrel. That is, the hollow chambers may be directed in a horizontal direction in order to project gases perpendicularly relative to the firearm's sights.

Figure 5:
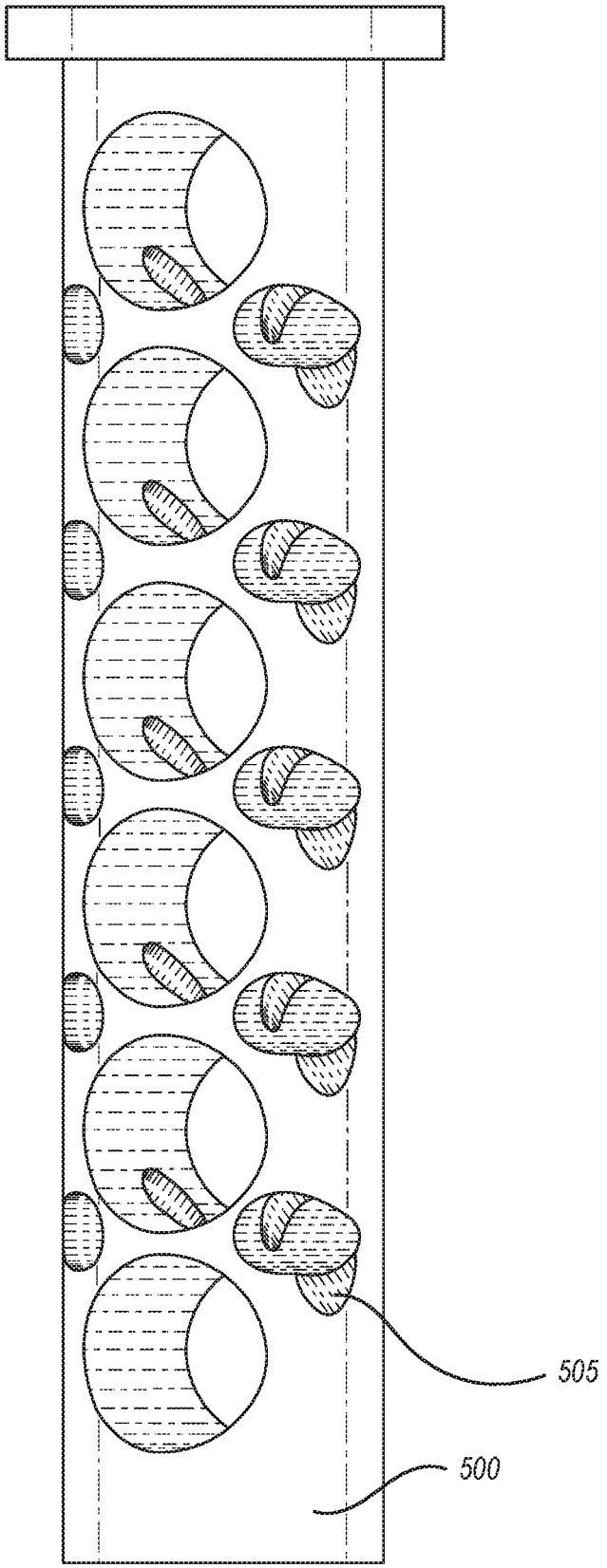
FIG. 5 more fully illustrates the connected hollow chambers.

FIG. 5 shows suppressor core 500 that more fully illustrates the set of proximate and interconnected small exit chambers (e.g., small exit chamber 505). As shown in FIG. 5, the bore hole constituting small exit chamber 505 extends the entire width of the suppressor core 500. That is, it is possible to see the other side (e.g., the white open area) of the suppressor core 500 by looking through the small exit chamber 505. As discussed above, the small exit chamber 505 is actually comprised of two separate but interconnected chambers. More specifically, small exit chamber 505 includes a first chamber that may be angled perpendicularly to the central through hole and a second chamber that is angled in a non-perpendicular manner relative to the central through hole. It will be appreciated that these angles may be set to any degree. For instance, the angle difference from being perfectly perpendicular may be as little as a 1 degree offset or may be as much as an 89 degree offset.

Figure 6:
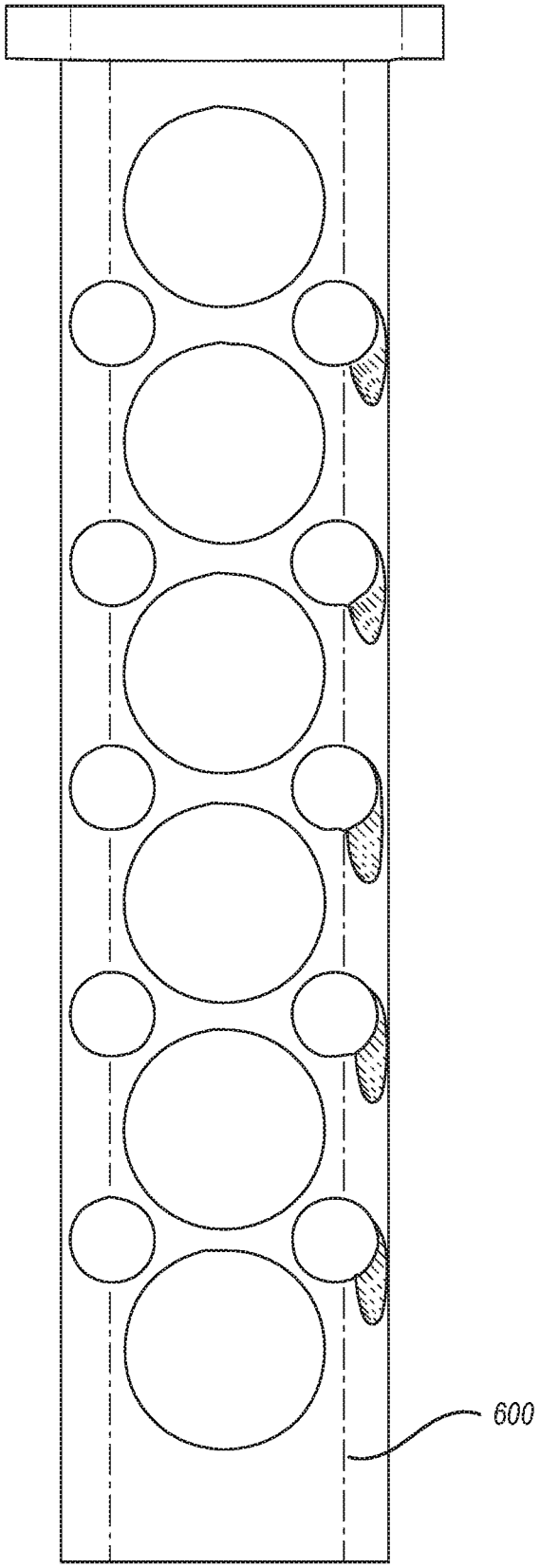
FIG. 6 illustrates another view of the suppressor.

FIG. 6 shows another perspective view of suppressor core 600, which is representative of the suppressor cores discussed thus far. Again, it is observable that suppressor core 600 includes one set of perpendicular single small exit chambers (e.g., those on the left-hand side) and another set of small exit chambers that are actually comprised of multiple chambers (e.g., those on the right-hand side). In this rotation, it should be noted that the small exit chamber 110 from FIG. 1 are actually now on the left-hand side of the suppressor shown in FIG. 6. As such, the non-perpendicular chambers are positioned on opposite sides of one another.

Figure 7:
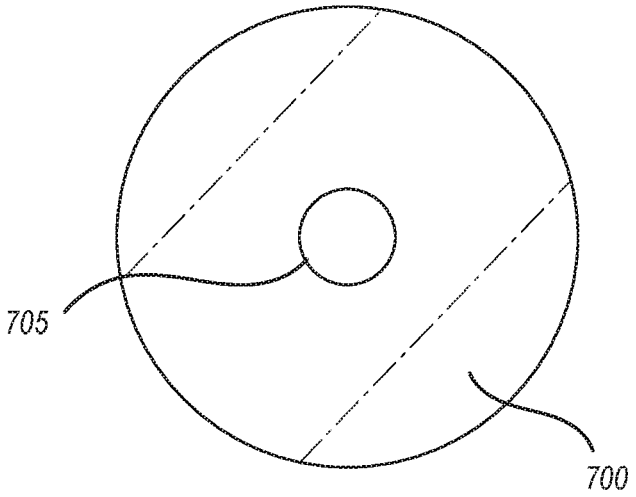
FIG. 7 illustrates the through-hole central chamber (aka a so-called projectile "borehole") of the suppressor.

FIG. 7 shows a view of suppressor core 700 in a manner to emphasize the projectile borehole 705. That is, projectile borehole 705 runs through the entire length of suppressor core 700 or the entire length of the elongate main body of the suppressor allowing for an entrance opening and an exit opening disposed on distal ends of the suppressor core 700. It will be appreciated that a projectile will travel the length of this projectile borehole 705 until the projectile exits the suppressor core 700. It will also be appreciated that the diameter of projectile borehole 705 (aka central through hole) may be designed to accommodate any caliber of ammunition.

The projectile borehole 705 may be disposed along a central axis inside the elongate main body as a central through hole or disposed along any inner length of the elongate body allowing the entrance and exit of the projectile. The entrance opening and exit opening of the projectile borehole 705 may comprise equal sizes or non-equal sizes relative to each other. In some cases, a filler may be provided in either one of the exit or entrance openings in order to modify their sizes. As a consequence, the same suppressor may potentially be used for multiple different ammunition calibers. For instance, suppose the suppressor's borehole is large enough to accommodate a 9 mm bullet. A 9 mm bullet is larger in size than a .223 bullet, yet the same suppressor can potentially be used for either caliber by modifying the end portions that attach to the firearm's barrel. By way of example, when used with a 9 mm bullet, the entrance opening (i.e. the part connected to the firearm's barrel or the so-called barrel-connecting end) may be unmodified. In contrast, when a .223 caliber firearm is connected to the suppressor, a filler material may be used in the entrance opening to ensure a secure and snug fit with the smaller sized barrel.

The projectile borehole may be structured as a hollow chamber of uniform diameter throughout the length of the suppressor core 700, or may taper or expand to any number of diameters or sizes as disposed along an elongated axis of the suppressor core 700. That is, the diameter of the borehole may progressively change in size along the length of the suppressor, with potentially a larger diameter near the barrel-connecting end of the suppressor and a smaller diameter near the projectile exit end of the suppressor, or vice versa. It should also be appreciated that the suppressor core 700 itself may be structured as an elongate cylindrical body having opposing ends of uniform diameter or may be structured such that a first end of a larger diameter may taper to a smaller diameter of a second end.

Figure 8:
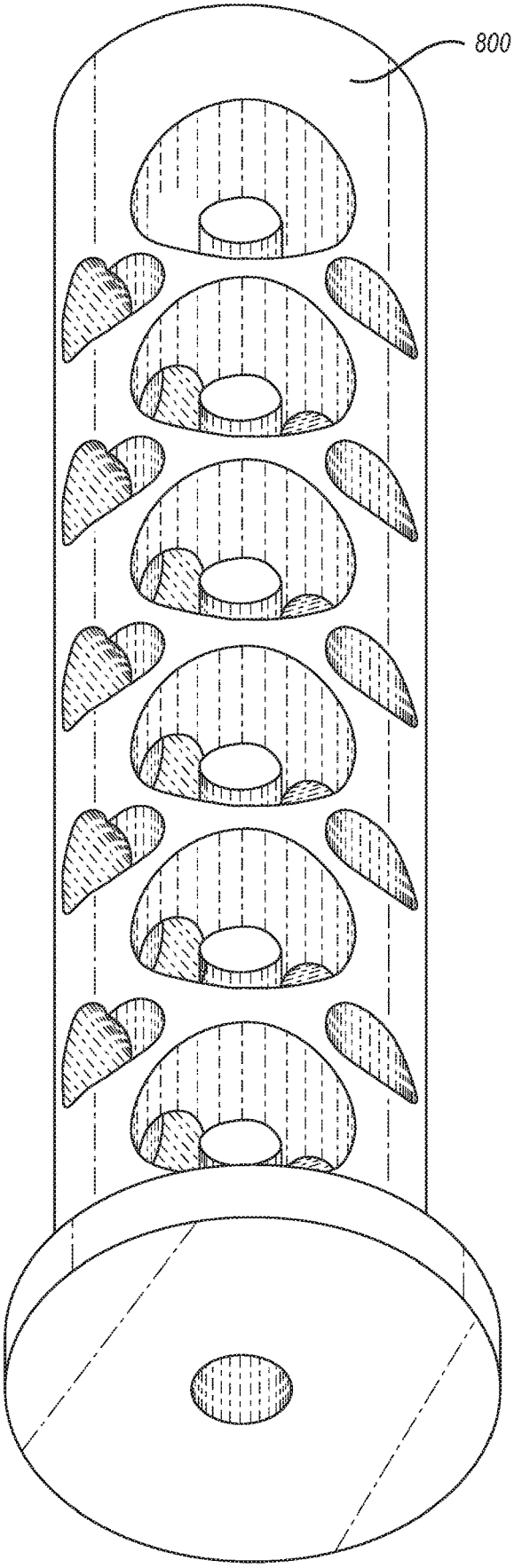
FIG. 8 illustrates an angled view of the suppressor.

FIG. 8 shows an angled view of suppressor core 800. Here, it is possible to see how the central through hole (or the projectile borehole) runs the length of suppressor core 800 and how the large exit chambers and each of the small exit chambers communicate with the central through hole. In this manner, at least some of the propellant gas may disperse, expand, and/or be redirected through these chambers. FIG. 8 also shows how the left-hand set of interconnected small exit chambers are positioned proximately to one another and how at least one chamber in the set redirects propellant gas in a non-perpendicular manner (as a result of the bore hole angling).

Figure 9:
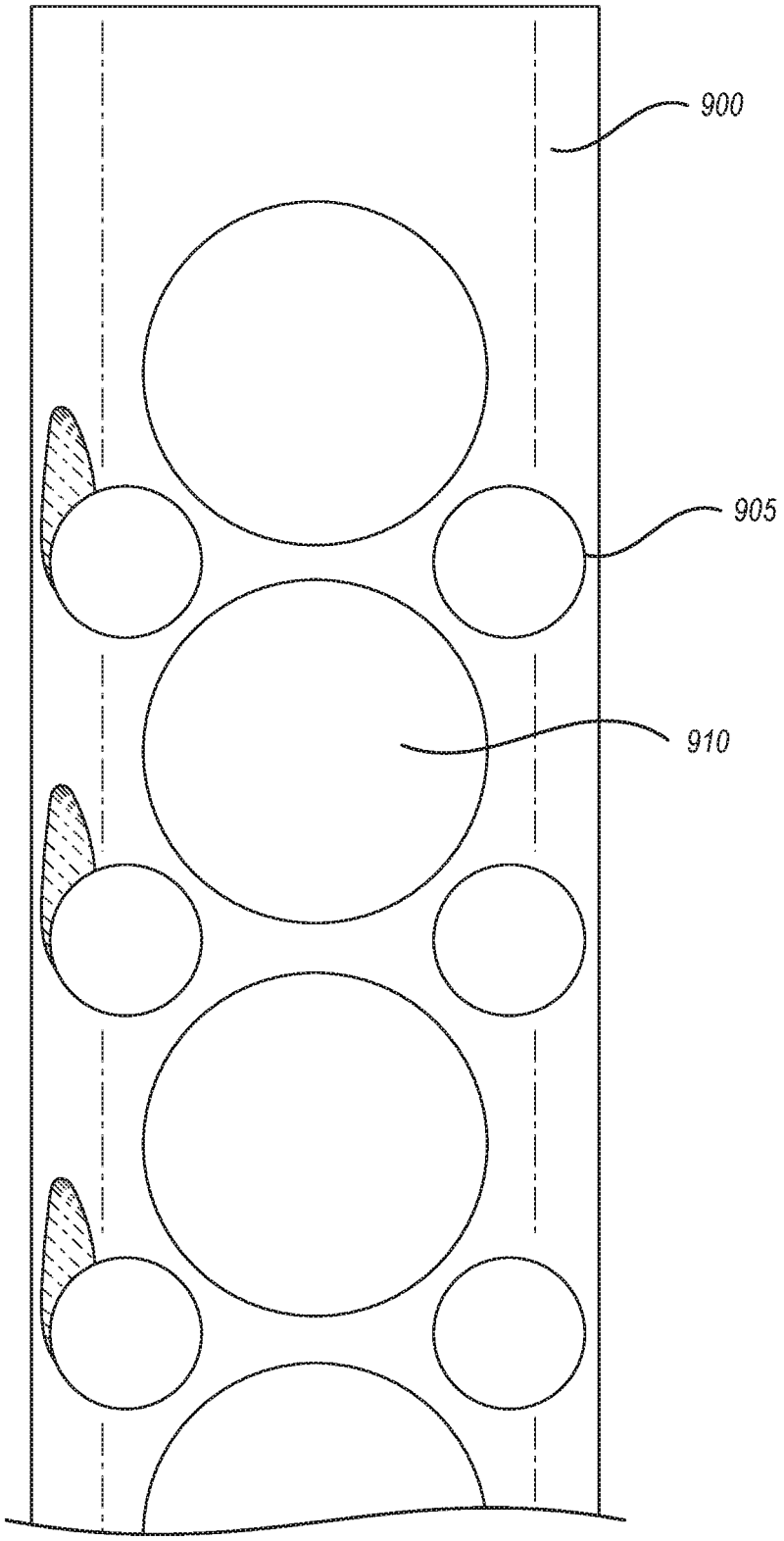
FIG. 9 shows some of the baffle/hollow chambers of the suppressor.
Figure 10:
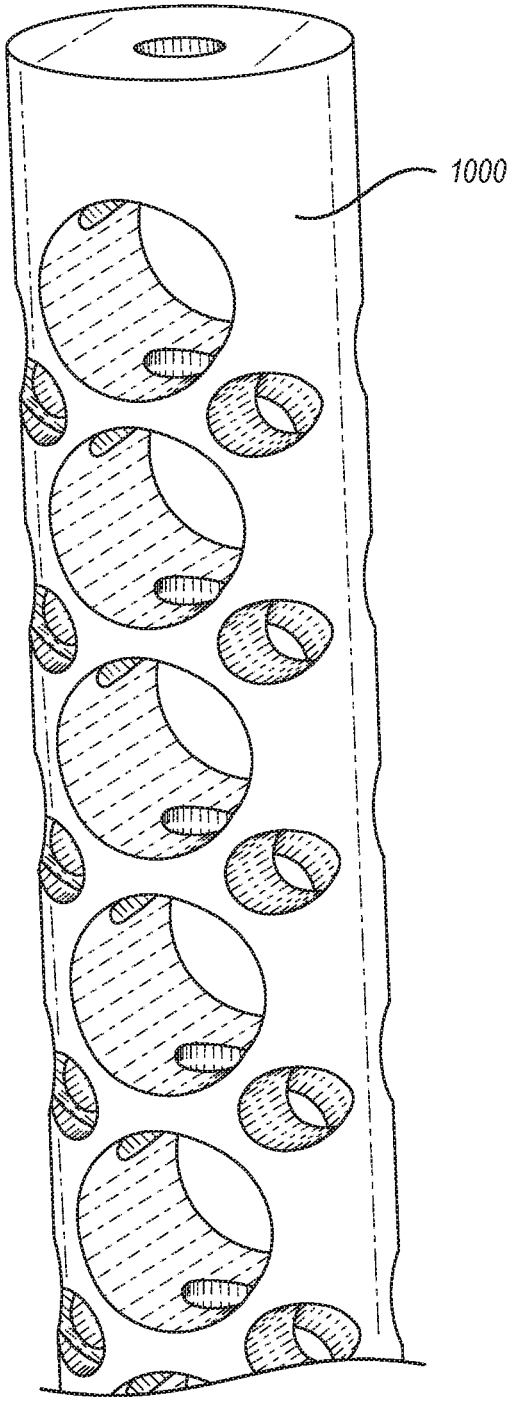
FIG. 10 shows some of the connections between the different chambers.
Figure 11:
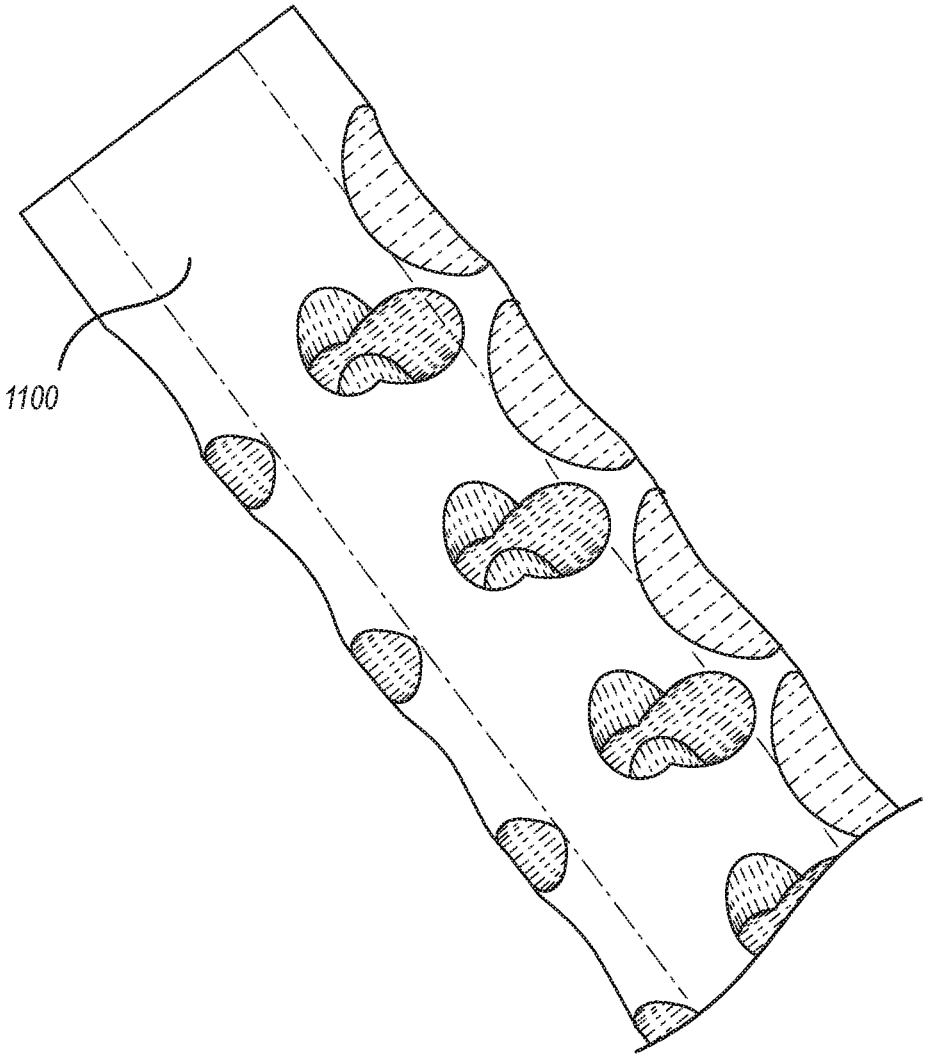
FIG. 11 illustrates additional connections between the chambers.
Figure 12:
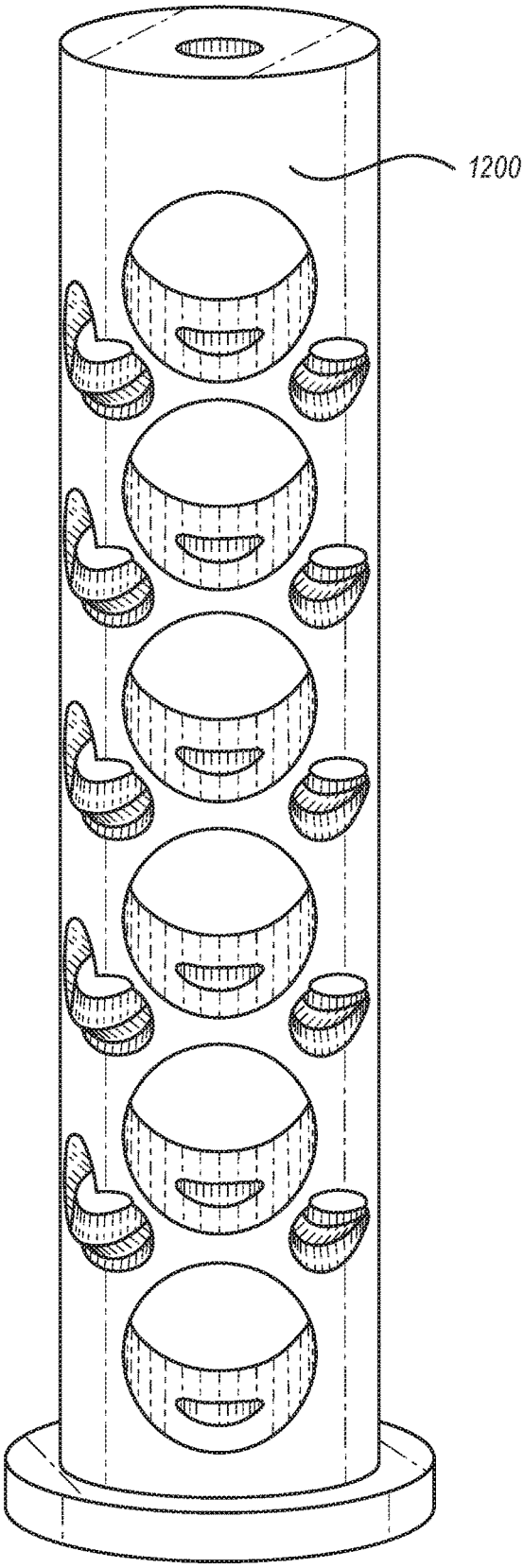
FIG. 12 provides another view of how the chambers are interconnected with one another.
Figure 13:
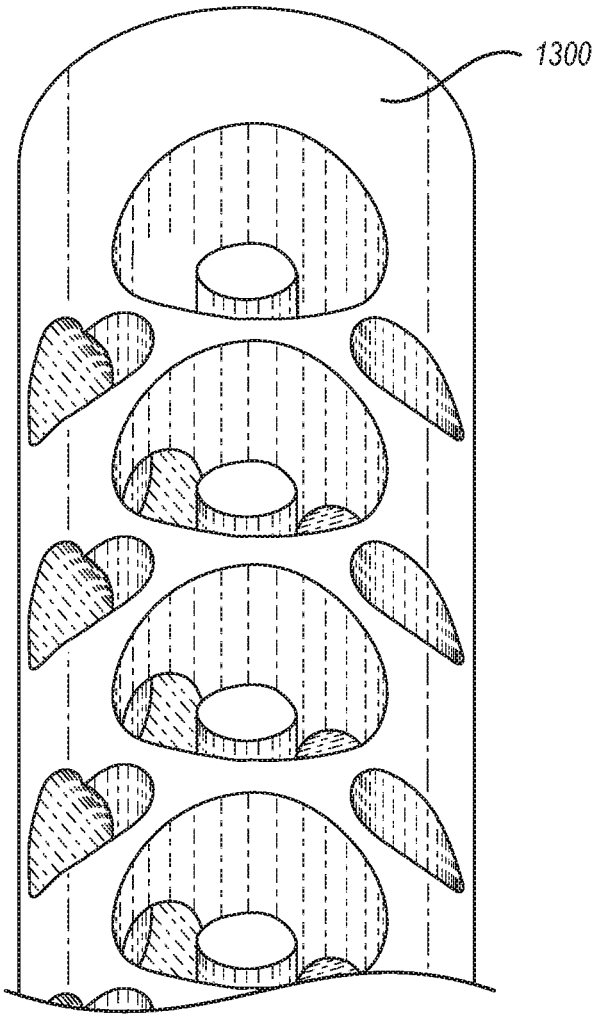
FIG. 13 illustrates another angled view of the suppressor.
Figure 14:
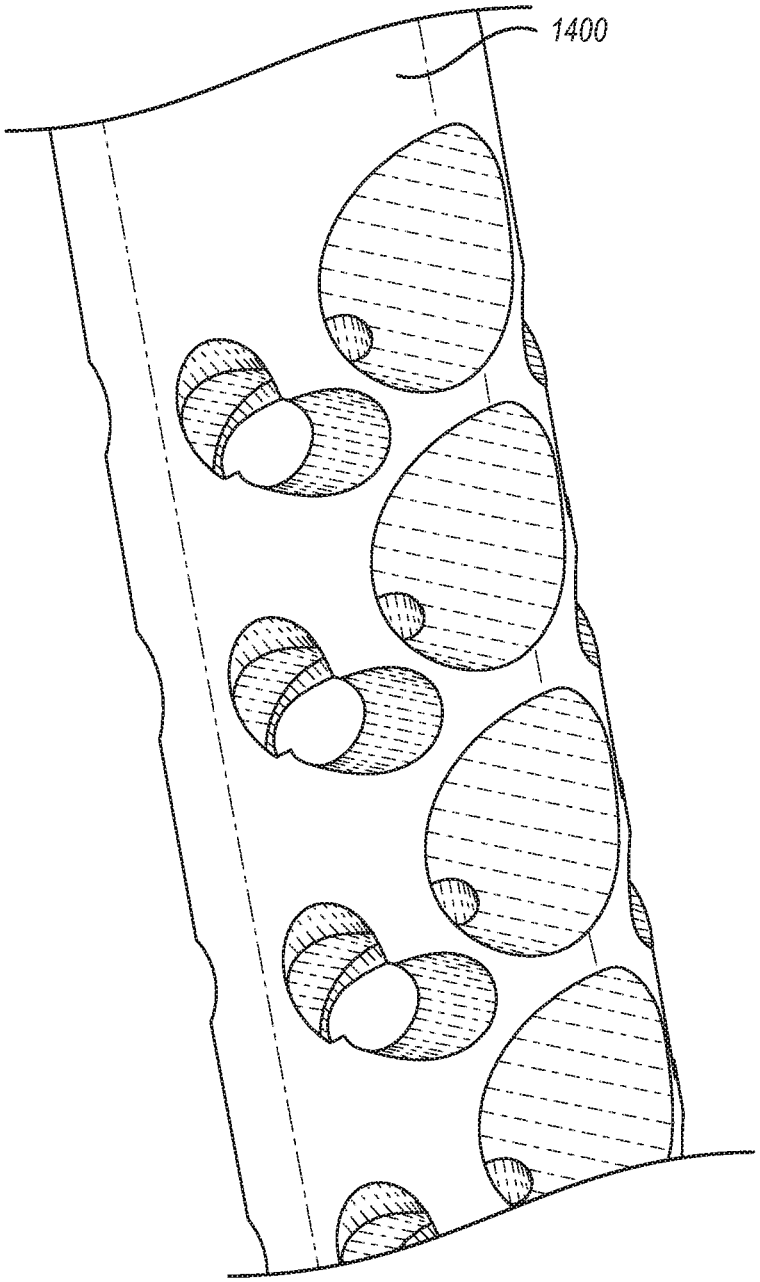
FIG. 14 illustrates another view of how the chambers are interconnected with one another.

FIG. 9 shows suppressor core 900 as well as a small exit chamber 905 and a large exit chamber 910. FIG. 10 shows a suppressor core 1000 as well as how the chambers are interconnected with one another. FIG. 11 shows a suppressor core 1100, and particularly emphasizes the set of proximate and interconnected small exit chambers. Similarly, FIG. 12 shows a suppressor core 1200, which includes the large and small exit chambers. FIG. 13 shows how the central through hole runs the entire length of the suppressor core 1300. Finally, FIG. 14 shows a suppressor core 1400 and particularly emphasizes the set of proximate and interconnecting small exit chambers. The suppressors in these figures are representative of the suppressors shown in the earlier figures.

In some embodiments, the monolithic core or suppressor core includes multiple hollow chambers, where each hollow chamber includes a first opening and a second opening. Some of the hollow chambers may be structured as a first perpendicular hollow chamber disposed in a perpendicular direction relative to the to the projectile borehole, a second perpendicular hollow chamber disposed in a perpendicular direction relative to the projectile borehole, and as a third perpendicular hollow chamber disposed in a perpendicular direction relative to the projectile borehole. Some of the hollow chambers may also be structured as a first non-perpendicular hollow chamber disposed in a non-perpendicular direction relative to the projectile borehole and a second non-perpendicular hollow chamber disposed in a non-perpendicular direction relative to the projectile borehole. In some cases, the second and third perpendicular chambers and the first and second non-perpendicular chambers comprise a smaller diameter than the first perpendicular chamber. Optionally, the first opening of the first non-perpendicular hollow chamber interconnects with the first opening of the second perpendicular hollow chamber, and the first opening of the second non-perpendicular hollow chamber interconnects with the first opening of the third perpendicular hollow chamber.

Figure 15:
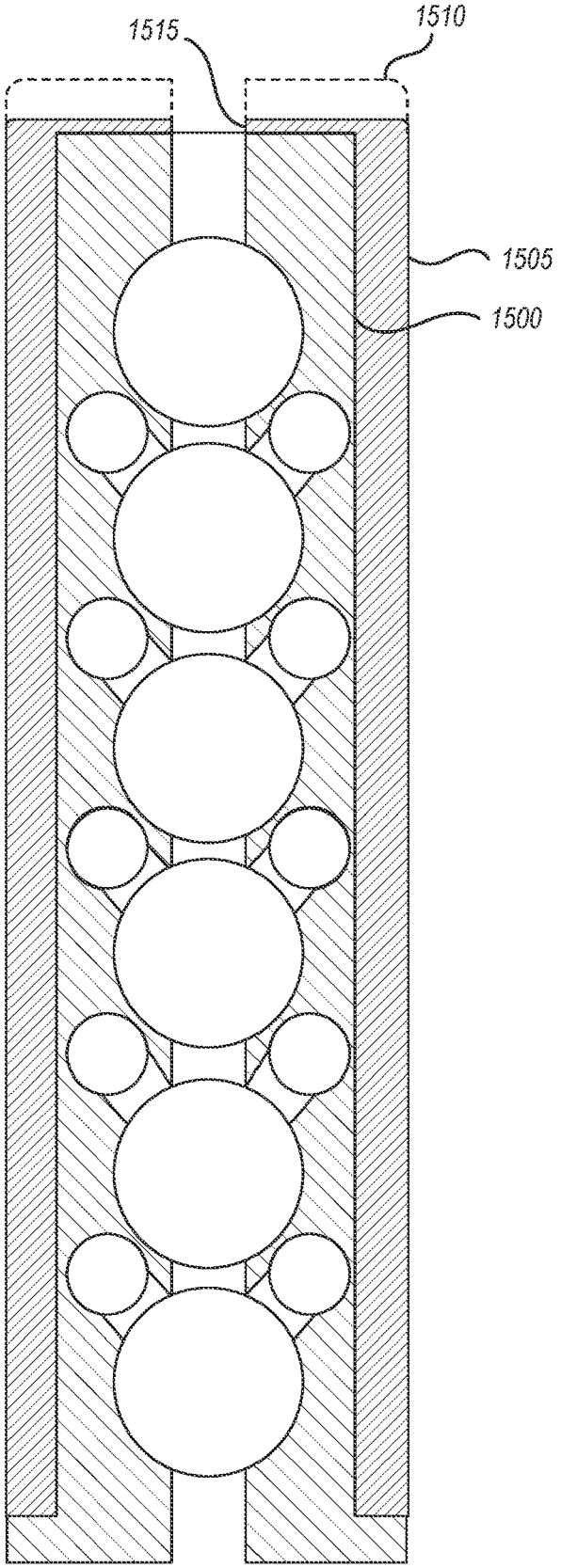
FIG. 15 illustrates a cross-sectional view of the suppressor with a detachable sleeve.

FIG. 15 shows the suppressor core 1500 (or monolithic core, which includes an elongate main body) as well as a removable sleeve 1505 structured to envelope the elongate main body of the suppressor core 1500. It should be appreciated that the sleeve end 1510 housing the exit opening 1515 of the removable or attachable sleeve 1505 may extend any length past the end of the suppressor core 1500 (as shown by the dotted line in FIG. 15) and the opening 1515 of the sleeve 1505 may comprise any number of sizes, shapes or diameters. Here, an opening 1515 of the sleeve 1505 aligns with the exit opening of the suppressor core 1500. The opening 1515 of the sleeve 1505 is shown as having a uniform diameter. If the monolithic core is non-cylindrical in shape, then the sleeve 1505 will also be non-cylindrical in shape and will correspond to the shape of the monolithic core. If the monolithic core is cylindrical in shape, then the sleeve 1505 will also be cylindrical in shape and will correspond to the cylindrical shape of the monolithic core.

FIG. 15 also shows the removable sleeve 1505 to be further structured, when enveloping the elongate main body (e.g., the suppressor core 1500), to be flush against the elongate main body. In some embodiments, the removable sleeve 1505 may be structured, when enveloping the elongate main body, to be flush against some portions of the elongate main body and not flush against other portions of the elongate main body. For instance, the elongate main body may include a spiral-like protrusion (or any other type or shape of protrusion) on its outer surface, where the removable sleeve is flush against this protrusion but is not flush against other portions of the outer surface. With this configuration, the gas created from the firing of the projectile can not only expand throughout the hollow chambers, but it may also expand in the non-flush areas between the elongate main body and the removable sleeve.

In this manner, the propellant gas may have further opportunity to expand into a greater volume of exit chambers, channels, or hollowed out regions, and decreased pressure will be forced on the removable sleeve. In one example, the removable sleeve may be structured with a hollowed-out threading of spiral channeling of specific width and depth, where the propellant gas released from the firearm's barrel into the suppressor core may travel from the suppressor core into the channeling of the sleeve for further expansion.

Figure 16:
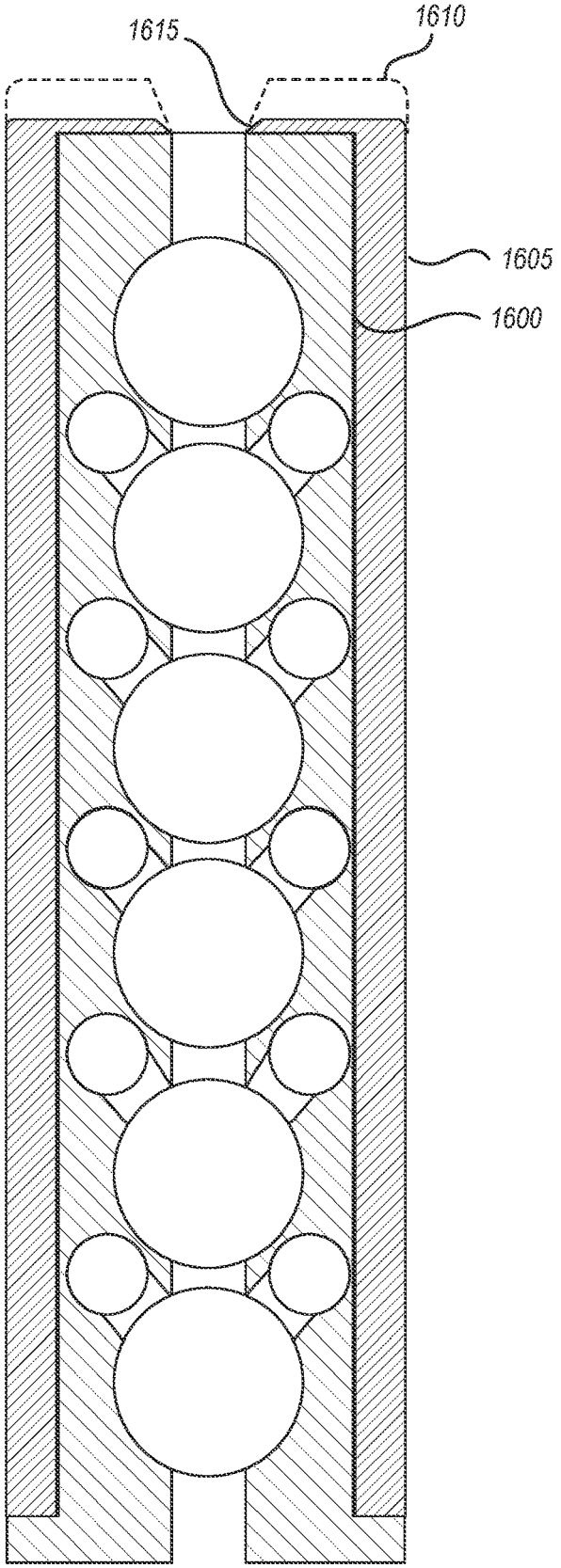
FIG. 16 illustrates a cross-sectional view of the suppressor with an alternate structural configuration for the detachable sleeve.

FIG. 16 shows a suppressor core 1600, which is representative of the previously-described suppressors, as well as an alternate embodiment of the removable sleeve 1605 structured to cover or slide over the elongate main body of the suppressor core 1600. Here, an opening 1615 of the sleeve 1605 aligns with the exit opening of the suppressor core 1600. The opening 1615 of the sleeve 1605 is shown as being tapered outward toward the outer surface of the suppressor core 1600 or sleeve 1605. In similar manner to FIG. 15, the sleeve end 1610 housing the exit opening 1615 of the removable or attachable sleeve 1605 may extend to any length past the end of the suppressor core 1600. The tapering of the opening 1615 may help with directing the emitting gases to a particular direction or pattern.

With that said, attention will now be directed to a discussion on "point of impact" shift, or simply "POI" shift. A POI shift refers to the change in position, or rather impact, of a bullet as a result of adding a suppressor to a firearm. This POI shift occurs because the harmonics of the firearm change as a result of the added suppressor. Due to the improved design of the disclosed suppressor cores, the embodiments are able to achieve minimal, and in some cases, no POI shift.

The material used for the suppressor core may be any suitable material used for suppressor cores. Examples include, but are not limited to, aluminum, steel, or even titanium. In this regard, the material may be bored with different sized chambers (e.g., different diameters or different volumes) to allow the propellant gas to disperse more fully. Additionally, suitable materials may include porous materials such as porous aluminum, other porous metals, or porous composite materials such as carbon fiber composite. It is anticipated that the present invention may be manufactured through drilling, hollowing, boring, CNC machining, 3D printing, or chemical processes to achieve the unique bi-directional or multi-directional channeling of the propellant gas through the suppressor core.

Additionally, in some embodiments, the suppressor core is outfitted with a detachable sleeve. In some embodiments, this sleeve is made of multiple different layered materials. In some embodiments, the multiple layers may comprise materials structured to facilitate insulation of a heat created by the firearm's discharge or may be structured to provide additional strength or reinforcement to the suppressor core. For instance, the outer portion of the sleeve (i.e. the portion touching the outer portion of the suppressor core) is comprised of a carbon fiber type material which is able to readily disperse heat, or rather to not absorb heat. The inner portion or layer of the sleeve may be comprised of a sheet of titanium. In this regard, a carbon fiber layer can be placed on the outside of the sleeve, and the titanium layer can be placed on the inside of the sleeve, thereby creating a sleeve having multiple different layers of differing material types. By configuring the sleeve in this manner, an operator of the firearm will be able to manipulate the suppressor (including the core and the sleeve) even after multiple rounds of ammunition have been fired therethrough such that it is hot.

In some embodiments, only the sleeve portion is stamped with a serial number while the core is not stamped with a serial number. In this regard, the core, which receives the bulk of the wear and tear, can be easily replaced while the sleeve can be used for an extended duration. To clarify, the sleeve will always be the part that is serialized.

Accordingly, the disclosed embodiments beneficially provide an improved suppressor (including core and sleeve) design that enhances the use of a corresponding firearm. By structuring the chambers in the manner described and illustrated in the Figures, significant advantages and benefits may be achieved, such as, for example minimal POI shift, heat dispersion (including the prevention of heat distortion near the aiming mechanisms), and interchangeability.

The present invention may be embodied in other specific forms without departing from its spirit or characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A firearm suppressor comprising:

a monolithic core comprising an elongate main body, a projectile borehole extending an entire length of the elongate main body such that the elongate main body includes both an entrance opening for the projectile borehole and an exit opening for the projectile borehole, and a plurality of hollow chambers, wherein:

the entrance opening is structured to attach to an end portion of a barrel of a firearm, the plurality of hollow chambers is disposed along the length of the elongate main body and connects the projectile borehole to an outer surface of the elongate main body, a first hollow chamber of the plurality of hollow chambers is disposed in a perpendicular direction relative to the projectile borehole, and a second hollow chamber of the plurality of hollow chambers is disposed in a non-perpendicular direction relative to the projectile borehole; and a detachable sleeve configured to cover the outer surface of the elongate main body, wherein the detachable sleeve further comprises an inner layer and an outer layer, and wherein the outer layer is comprised of an insulating material.

2. The firearm suppressor of claim 1 further comprising a first set of proximate, interconnected hollow chambers, wherein a portion of the first hollow chamber interconnects with a portion of the second hollow chamber.

3. The firearm suppressor of claim 2 further comprising a second set of proximate, interconnected hollow chambers, wherein:

the first set of proximate, interconnected hollow chambers is structured to direct a volume of propellant gas in a first direction, and the second set of proximate, interconnected hollow chambers is structured to direct a volume of propellant gas in a second direction.

4. The firearm suppressor of claim 2, wherein:

the first set of proximate, interconnected hollow chambers is disposed in a top position of the elongate main body, and the second set of proximate, interconnected hollow chambers is disposed in a bottom position of the elongate main body such that the second set of proximate, interconnected hollow chambers are positioned on an opposite side of the firearm suppressor relative to the first set of proximate, interconnected hollow chambers.

5. The firearm suppressor of claim 1, wherein the plurality of hollow chambers comprises chambers having larger diameters and chambers having smaller diameters.

6. The firearm suppressor of claim 1, wherein the plurality of hollow chambers comprises chambers having larger volumes and chambers having smaller volumes.

7. The firearm suppressor of claim 6, wherein the chambers having larger volumes are located at uniform distances along the length of the elongate main body.

8. The firearm suppressor of claim 7, wherein the chambers having smaller volumes are located at uniform intervals adjacent to the chambers having larger volumes.

9. The firearm suppressor of claim 7, further comprising a plurality of proximate, interconnected hollow chambers located at uniform intervals adjacent to the chambers having larger volumes.

10. The firearm suppressor of claim 9, wherein each hollow chamber in the plurality of proximate, interconnected hollow chambers has an equal size.

11. The firearm suppressor of claim 1, wherein the elongate main body is cylindrical in shape.

12. The firearm suppressor of claim 1, wherein the plurality of hollow chambers comprises one or more of the following: a cylindrical shape or a non-cylindrical shape.

13. A firearm suppressor comprising:

a monolithic core comprising an elongate main body, a projectile borehole extending an entire length of the elongate main body such that the elongate main body includes both an entrance opening for the projectile borehole and an exit opening for the projectile borehole, and a plurality of hollow chambers, wherein:

the entrance opening is structured to attach to an end portion of a barrel of a firearm, the plurality of hollow chambers is disposed along the length of the elongate main body and connects the projectile borehole to an outer surface of the elongate main body, a first hollow chamber of the plurality of hollow chambers is disposed in a perpendicular direction relative to the projectile borehole, a second hollow chamber of the plurality of hollow chambers is disposed in a non-perpendicular direction relative to the projectile borehole, and at least some hollow chambers in the plurality of hollow chambers are disposed horizontally along the elongate main body to project gases in a direction perpendicular relative to a firearm sight; and a removable sleeve structured to envelope the elongate main body and is further structured, when enveloping the elongate main body, to be flush against at least a portion of the elongate main body.

14. The firearm suppressor of claim 13, further comprising a pair of proximate, interconnected hollow chambers, wherein a portion of the first hollow chamber interconnects with a portion of the second hollow chamber.

15. A firearm suppressor comprising:

a monolithic core comprising an elongate main body, a projectile borehole extending an entire length of the elongate main body such that the elongate main body includes both an entrance opening for the projectile borehole and an exit opening for the projectile borehole, and a plurality of hollow chambers, wherein:

the entrance opening is structured to attach to an end portion of a barrel of a firearm, the plurality of hollow chambers is disposed along the length of the elongate main body and connects the projectile borehole to an outer surface of the elongate main body, a first hollow chamber of the plurality of hollow chambers is disposed in a perpendicular direction relative to the projectile borehole, a second hollow chamber of the plurality of hollow chambers is disposed in a non-perpendicular direction relative to the projectile borehole, and the first hollow chamber and the second hollow chamber are configured as a pair of proximate, interconnected hollow chambers with a portion of the first hollow chamber interconnecting with a portion of the second hollow chamber; and a removable sleeve structured to envelope the elongate main body and is further structured, when enveloping the elongate main body, to be flush against at least a portion of the elongate main body such that the removable sleeve is configured to cover the outer surface of the elongate main body, wherein the removable sleeve further comprises an inner layer and an outer layer, and wherein the outer layer is comprised of an insulating material.

16. The firearm suppressor of claim 15, wherein each of the hollow chambers of the plurality of hollow chambers comprises a first opening and a second opening, and the plurality of hollow chambers further comprises:

a first perpendicular hollow chamber disposed in a perpendicular direction relative to the projectile borehole, a second perpendicular hollow chamber disposed in a perpendicular direction relative to the projectile borehole, a third perpendicular hollow chamber disposed in a perpendicular direction relative to the projectile borehole, a first non-perpendicular hollow chamber disposed in a non-perpendicular direction relative to the projectile borehole, and a second non-perpendicular hollow chamber disposed in a non-perpendicular direction relative to the projectile borehole, wherein:

the second and third perpendicular chambers and the first and second non-perpendicular chambers have a smaller diameter than a diameter of the first perpendicular chamber, the first opening of the first non-perpendicular hollow chamber interconnects with the first opening of the second perpendicular hollow chamber, and the first opening of the second non-perpendicular hollow chamber interconnects with the first opening of the third perpendicular hollow chamber.

* * * * *